United States Patent [19]

Bojsen

[11] Patent Number: 4,752,309

[45] Date of Patent: Jun. 21, 1988

[54] RAPPING MECHANISM FOR RAPPING THE ELECTRODES OF AN ELECTROSTATIC PRECIPITATOR

[75] Inventor: Erik M. Bojsen, Valby, Denmark

[73] Assignee: F. L. Smidth & Co. A/S, Valby, Denmark

[21] Appl. No.: 79,802

[22] Filed: Jul. 30, 1987

[30] Foreign Application Priority Data

Aug. 11, 1986 [DK] Denmark ..... 3811/86

[51] Int. Cl.[4] ..... B03C 3/76

[52] U.S. Cl. ..... 55/112; 55/148; 55/149; 55/300

[58] Field of Search ..... 55/112, 300, 304, 148, 55/149

[56] References Cited

U.S. PATENT DOCUMENTS

| | | | |
|---|---|---|---|
| 2,518,995 | 8/1950 | Owen | 55/112 X |
| 2,722,992 | 11/1955 | Roberts et al. | 55/112 |
| 3,708,962 | 1/1973 | Deguchi et al. | 55/300 |
| 3,831,351 | 8/1974 | Gibbs et al. | 55/148 X |

FOREIGN PATENT DOCUMENTS

| | | | |
|---|---|---|---|
| 370148 | 1/1922 | Fed. Rep. of Germany | 55/112 |
| 432674 | 8/1926 | Fed. Rep. of Germany . | |
| 26383 | 11/1923 | France | 55/112 |
| 1201832 | 1/1960 | France . | |

*Primary Examiner*—Kathleen J. Prunner
*Attorney, Agent, or Firm*—Brumbaugh, Graves, Donohue & Raymond

[57] ABSTRACT

A rapping mechanism for the rapping of discharge and field electrodes in a high voltage driven electrostatic precipitator used for the cleansing of smoke laden gases from industrial plants, power works etc. The rapping effect is obtained by metal balls which run from the top of the precipitator to its bottom along a number of sloping tracks which are mounted stepwise, with differences of level, on the electrodes or on the carrying frames of same. A single ball in connection with its changing from one track to the following track, when falling freely and moving horizontally, hits both the underlying track and a stop mounted near the lower end of the track thereby causing each electrode carrying frame to receive two consecutive blows of different force so that the frame is rapped and the deposited dust is loosened and falls off. A lifting device of known type carries the balls from a terminated passage down along the tracks to a starting position for a renewed passage of the tracks.

5 Claims, 3 Drawing Sheets

RAPPING MECHANISM FOR RAPPING THE ELECTRODES OF AN ELECTROSTATIC PRECIPITATOR

BACKGROUND OF THE INVENTION

The invention relates to the rapping of discharge and field electrodes in a high voltage driven electrostatic precipitator for the cleansing of smoke laden gases from industrial plants, power works etc. Such rapping is necessitated by the fact that due to the mode of operation of the precipitator dust will settle on the electrodes and has therefore, at intervals, to be removed from same by transferring an impact force to the electrodes so that these are subjected to a forceful vibration by which the deposited dust is loosened.

The necessary impact force for the rapping of the electrodes is usually obtained by a number of hammers fixed to a rotary shaft which spans the width of the precipitator, and which are lifted upwards from a vertical pendent position in order to be released so that they fall back towards their vertical position. For each individual hammer a bar or a lever is rapped by the hammer when it falls back, the bar/lever transferring the supplied impact energy to a section of precipitator electrodes.

Whether the hammers, as it is known from the rapping mechanism according to U.S. Pat. No. 3,844,742, are moved 360 degrees about their suspension shaft, or as described in GB No. 2 138 710 are moved ony 180 degrees at the most, such a rapping mechanism requires quite a lot of space at the bottom of the precipitator sections or above these, as the length and/or height of the house enclosing the precipitator has to be enlarged accordingly, resulting in an additional consumption of materials and space.

Furthermore, the bearings from which the hammers are suspended and rotating and the bearings which support the rotary shaft operate in highly dust-laden surroundings, which involves hard wear.

Another known mechanism for the rapping of electrodes is shown in DE-PS No. 370 148 according to which the released energy from the impact of a freely falling ball against an electrode or its carrying frame is utilized for the rapping whereafter the ball is led back by a lifting device to its starting position before the rapping. The advantage of this mechanism is that in a very simple way it solves some of the existing insulation problems of an electrostatic precipitator in avoiding undesirable sparkovers between the electrodes and the applied rapping mechanism. On the other hand it presupposes that each individual electrode suspension has a separate mechanism with its own ball and lifting device which, especially in larger electrostatic precipitators with many carrying frames, will involve a very complicated apparatus with many mobile parts.

It is therefore the object of the invention to provide a rapping mechanism to avoid the drawbacks of the above known mechanisms.

SUMMARY OF THE INVENTION

According to the invention, this is obtained by a rapping mechanism in which the number of mobile parts is reduced to a minimum, the rapping mechanism having a number of groove shaped tracks mounted with differences in level as successively descending steps and in fixed conenction with the carrying frames of the electrodes, and which in their longitudinal direction are sloping slightly downwards, and on which a metal ball supplied to the upper track from a ball inlet runs successively downwards along the sloping tracks, rolling on the tracks and passing the differences of level in a free fall, so that the necessary impact energy for rapping the electrodes is being procured by the ball hitting an underlying track and transferred from this track to the electrode section in question before the ball, via an outlet placed at the bottom of the electrostatic precipitator and the above-mentioned lifting device, is transferred back to the ball inlet.

Also according to the invention, a stop has been mounted near the lower end of each track, but spaced from the end in such a way that the horizontal movement of the ball is stalled without preventing its free fall onto the following track.

Such a stop may be mounted on the track proper or on the carrying frame in question, and when stalling a ball's horizontal movement the stop will receive an impact energy which, like the impact energy released through a vertical falling ball's hit against an underlying track, is transferred to the electrodes. In this way impact forces released through a ball's transfer from one track to the following will appear as two consecutive blows with increasing force against the track or the frame in question, a result which has previously only been possible to obtain by the application of specially placed hammers.

The falling distances of the ball are determined by the differences of level between the tracks which, being mounted on the carrying frames of the electrodes, are live with high voltage, and the differences of level are therefore chosen so that in any given position of a ball no sparkovers occur between the ball, the earth connected precipitator house and the electrode system.

According to the invention, the tracks may have a V- or bowl-shaped cross-section with an open bottom so that the ball's course along the track is laterally controlled, and at the same time it is ensured that dust goes not accumulate on the track.

The known lifting device which takes the balls from the ball outlet back to the ball inlet may by way of example consist in a vertical tube which is filled with balls or in a chain conveyor. In case of using the solution with the vertical tube one more ball than the tube can hold is added. This "free" ball is thus either on its way through the rapping system or is lying on the inlet of the lifting device. When starting a new rapping cycle, the lifting device forces the ball arriving at the bottom of the tube into the tube whereby the other balls in the tube are pushed upwards, and the uppermost one is pushed out of the tube onto the upper track from where it rolls downwards through the precipitator along the course formed by the tracks.

It is possible to alter the impact energy while the precipitator is operating simply by changing to lighter or heavier balls during the passage of the latter through the lifting device and simultaneously lead away balls, the weight of which no longer corresponds to the desired impact force.

The surprising new effect of the invention is therefore that by using one and the same ball a rapping or vibration of all carrying frames and thus of all electrodes in an electrostatic precipitator is obtained through the released impact energy from the same balls's consecutive falls down onto the tracks of the carrying frames and from its likewise consecutive blows against the horizontal stops, thereby also obtaining that each electrode's carrying frame is affected by two consecutive blows of increasing force.

Further features of the invention will be apparent from the following detailed description.

DESCRIPTION OF THE PREFERRED EMBODIMENT

Figure 1:
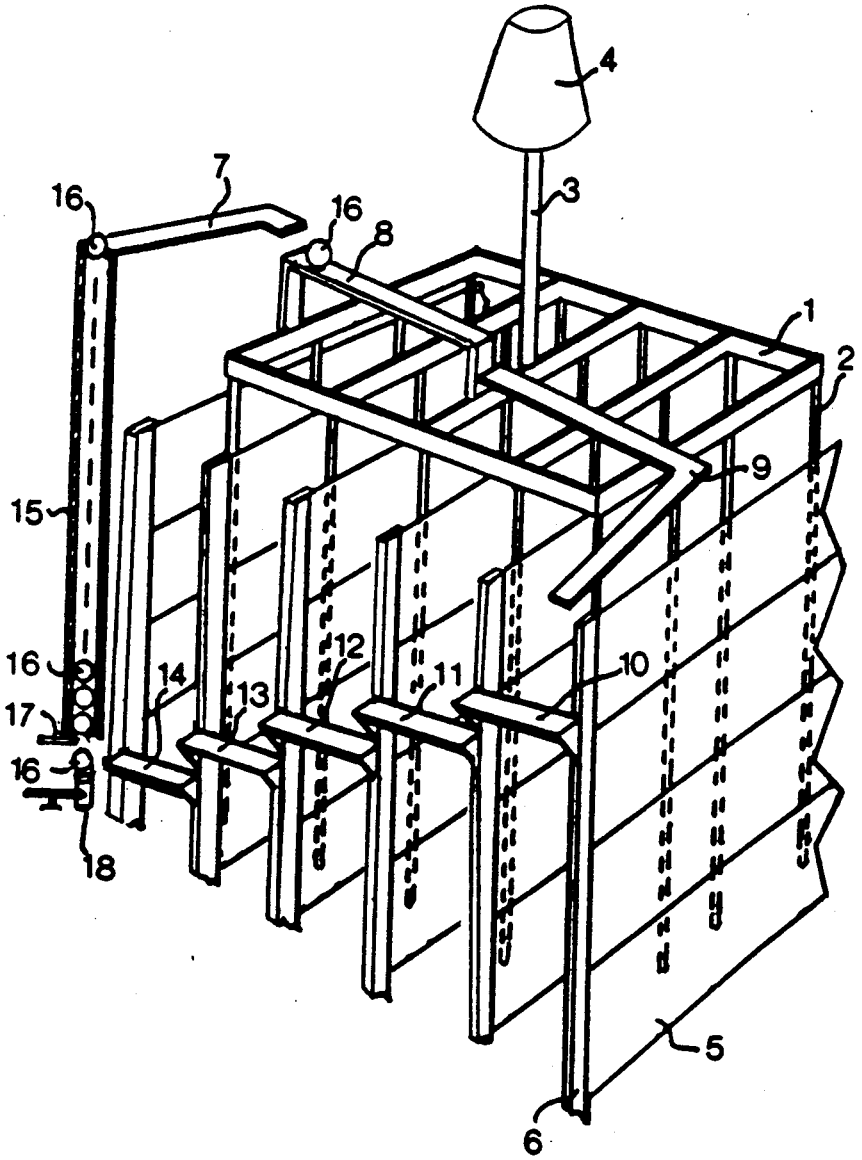
FIG. 1 shows, partly in cross-section, an electrostatic precipitator with tracks and appertaining lifting device FIG. 2 the mounting of a stop for the horizontal movement of a ball passing down through the precipitor and FIG. 3 a sectional view in the plane III—III of a detail of FIG. 2.

A carrying frame 1 for a precipitator's discharge or emission electrodes 2, the latter stretching vertically along the full height of a precipitator house (not shown), is suspended by a carrying rod 3 in a carrying insulator 4 resting on the top of the precipitator house.

Similarly, a number of field electrodes shown schematically as horizontal electrode plates 5 are mounted in carrying frames 6.

A ball inlet is shown as a track 7 from which a metal ball 16 falls down onto the track 8 mounted on the frame 1 of the emission electrodes 2 and to which the impact energy released by the ball's fall onto track 8 is transferred. The ball rolls along the track 8 to fall from the lower end of same down onto the track 9 which is likewise mounted on the carrying frame 1 of the emission electrodes, and to which the impact energy released by the fall and the hit is also transferred.

From the track 9 the ball falls down onto the track 10 which is mounted on the carrying frame 6 of the discharge electrodes 5 to which the impact energy released by this fall is transferred. The ball now moves down along the tracks 10–14 transferring, each time the ball falls from one track onto the following track, released impact energy via the respective carrying frames 6 to the respective electrodes 5 thus rapping the latter.

Figure 3:
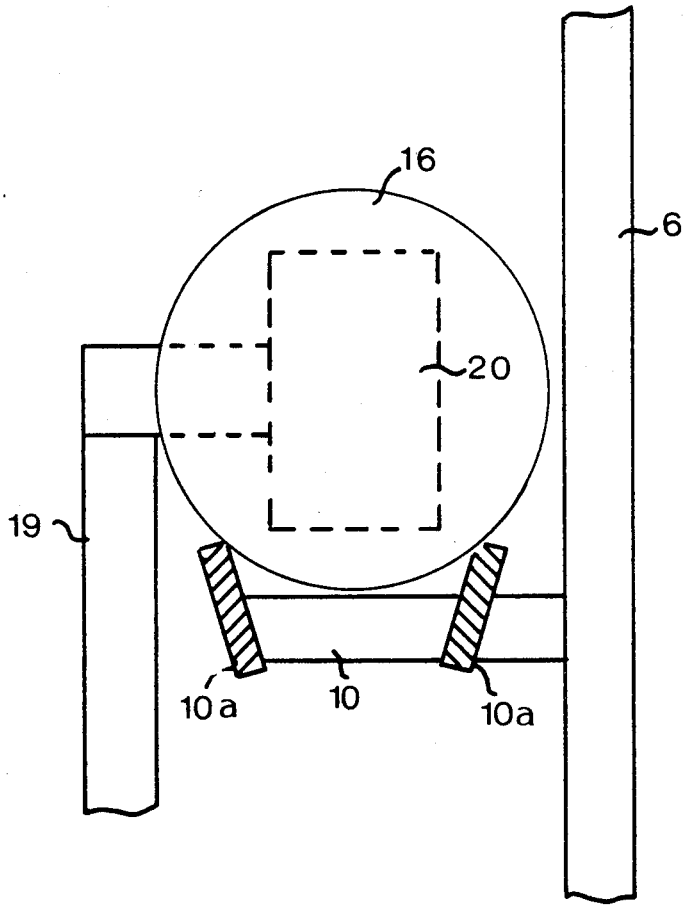

The preferred embodiment of the tracks appears in FIG. 3, the cross-section of the track 10 having a V- or bowl-shape with an open bottom allowing the ball 16 to run on the sloping sides 10a of the V or the bowl and from which dust, which inevitably will settle on the sloping sides, is shaken out through the open bottom.

Figure 2:
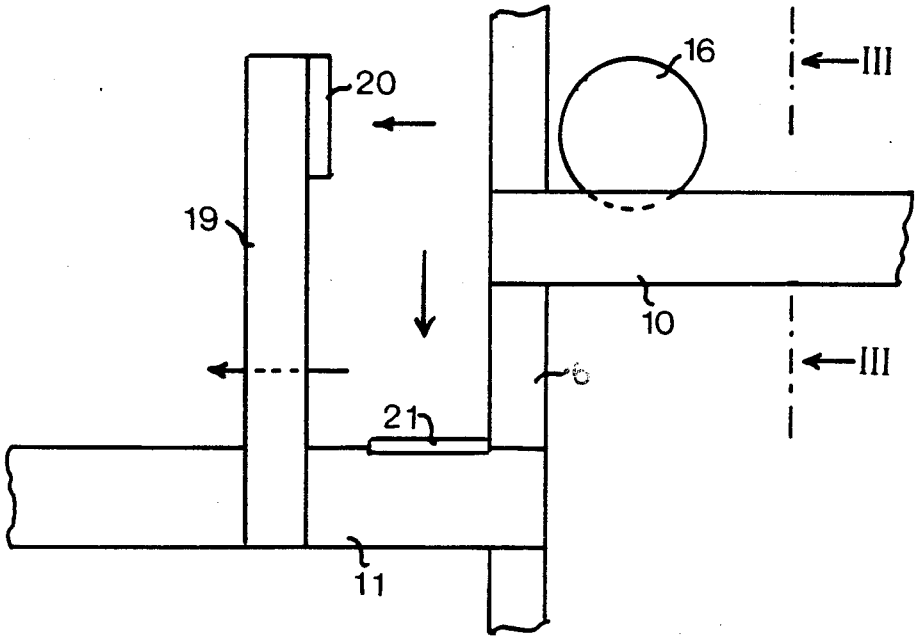

Another feature of the invention appears from FIG. 2 and is the mounting of a stop 20 on a bracket 19 at or near the lower end of each track at a distance corresponding to slightly more than a ball's 16 diameter from the end of the track. This stop 20 stalls the ball's horizontal move when leaving the track 10 and changes its direction of move into a practically vertical fall down onto an impact plate 21 of the following track 11, simultaneously transferring the impact energy released from the ball's hit against the stop 20 to the carrying frame 6 or track on which the stop is mounted and further to the electrodes. As the ball supplying and ball receiving track end of two consecutive tracks 10, 11, with a few exceptions, cf. FIG. 1, are mounted on the same carrying frame 6, the latter will thus receive two consecutive blows of increasing strength.

From the lowermost track 14 the ball is delivered to a not shown waiting position or ball outlet from which the ball by a lifting device 15, 17 and 18, preferably mounted outside the precipitator house, is taken to the ball inlet 7 for renewed passage down along the tracks.

The lifting device is in FIG. 1 shown as a tube 15 containing a number of balls and where a spring actuated pawl 17 prevents the balls 16 from falling out of the tube. When a ball has reached its waiting position near the lower inlet of the lifting device, and a new rapping cycle is desired, the ball is forced past the pawl 17 up into the tube 15 by means of a lifting block 18. Hereby the uppermost ball is pushed out of the tube onto the ball inlet track 7. By always using one more ball for the cycle than there is room for in the tube 15 it is ensured that a new ball is not admitted to the tracks before the one which is on its way down through the precipitator has reached the bottom inlet of the lifting device ready to be used for lifting the top ball out of the tube.

To alter the rapping force, the balls in use may be replaced by balls of a different weight at the entrance of the lifting device making it thus possible to alter the impact force while the precipitator is operating.

I claim:

1. A rapping mechanism for rapping of the discharge and field electrodes of an electrostatic precipitator comprising a metal ball, a groove shaped ball inlet placed above a number of likewise grooved tracks for attachment to carrying frames of said electrodes such that each track is attached to at least one carrying frame, a lifting device discharging the ball to the ball inlet, said groove shaped tracks being disposed in successively descending steps and with differences of level and in their longitudinal direction are sloping slightly downwards such that the metal ball supplied to the upper track from the ball inlet runs successively down the sloping tracks and passes in a free fall the stepwise differences of level between the tracks, whereby each track transfers the impact force from the ball's hit against the track to the attached electrode frame for the rapping of the electrodes.

2. The rapping mechanism according to claim 1, characterized in that at the lower end of each track a stop is mounted on the track at such a distance from the end of the track that the ball's approximately horizontal movement is stalled without preventing the ball's free fall whereby the impact energy from the ball's hit against the stop is also transferred to the carrying frames for the rapping of same.

3. A rapping mechanism according to claim 2 wherein each said track is attached to two adjacent carrying frames.

4. The rapping mechanism according to claim 1, characterized in that the groove shaped tracks have a V- or bowl-shaped cross-section with an open bottom.

5. A rapping mechanism according to claim 1 wherein each said track is attached to two adjacent carrying frames.

* * * * *